US006134848A

United States Patent [19]

Walter

[11] Patent Number: 6,134,848

[45] Date of Patent: Oct. 24, 2000

[54] TENT ROOF CONSTRUCTION WITH A FLEXIBLE COVER AT LEAST THE ROOF OF WHICH IS FORMED OF A THREE-DIMENSIONAL METAL OR COMPOSITE FRAMEWORK

[75] Inventor: Denis Walter, Schnersheim, France

[73] Assignee: Etablissements Lucien Walter Societe Anonyme, Brumath, France

[21] Appl. No.: 09/170,025

[22] Filed: Oct. 13, 1998

[30] Foreign Application Priority Data

Oct. 13, 1997 [EP] European Pat. Off. ..... 97440095

[51] Int. Cl.[7] ..... E04B 7/10

[52] U.S. Cl. ..... 52/63; 52/83; 52/222

[58] Field of Search ..... 52/63, 83, 81.1, 52/81.2, 81.3, 81.4, 81.5, 222

[56] References Cited

U.S. PATENT DOCUMENTS

| | | | |
|---|---|---|---|
| 3,611,649 | 10/1971 | Muller et al. | 52/83 X |
| 3,731,450 | 5/1973 | Du Chateau | 52/81.3 X |
| 3,863,659 | 2/1975 | Gillis | 52/83 X |
| 3,909,994 | 10/1975 | Richter | 52/63 |
| 4,841,688 | 6/1989 | Rinaldi | 52/63 |
| 4,878,322 | 11/1989 | Ikeda et al. | 52/83 X |
| 5,784,842 | 7/1998 | Wackerbauer | 52/222 |

FOREIGN PATENT DOCUMENTS

| | | | |
|---|---|---|---|
| 2302500 | 7/1973 | Germany | 52/63 |
| 2422990 | 11/1975 | Germany | 52/63 |
| 692955 | 10/1979 | Russian Federation | 52/63 |

*Primary Examiner*—Richard Chilcot
*Attorney, Agent, or Firm*—Harrison & Egbert

[57] ABSTRACT

A tent roof construction with a flexible cover at least the portion of which forming the roof is defined by a three-dimensional metal or composite framework has one or several frame modules (4) including at least two parallel longitudinal beams (5, 6) from which extend diagonal beams (9, 9A, 9B, 9C), both parallel longitudinal beams (5, 6) being defined by a profile bar (10) with grooves for receiving a retaining strip provided for at two longitudinal edges (13, 14) of one or several flexible covers with a double curvature (7), such a profile bar (10) being in addition provided with a mechanism for receiving the ends (16, 16A) of the diagonal beams (9, 9A, 9B, 9C) or also the cross-beams (8), with a view to their fixing.

14 Claims, 3 Drawing Sheets

TENT ROOF CONSTRUCTION WITH A FLEXIBLE COVER AT LEAST THE ROOF OF WHICH IS FORMED OF A THREE-DIMENSIONAL METAL OR COMPOSITE FRAMEWORK

BACKGROUND OF THE INVENTION (1) Field of the Invention

The invention relates to a tent roof construction with a flexible cover at least the portion forming the roof of which is defined by a three-dimensional metal or composite framework comprised of a frame module or a juxtaposition of several of these latter, each of which includes at least two parallel longitudinal beams, connected by means of cross beams, from which extend diagonal beams defining, as the case may be, two or more girders made integral by their top or even one or a series of pyramidally-shaped modules, within the inner space defined by such a frame module being understood to be at least one flexible cover of the type with a double curvature.

(2) Description of the Prior Art

Tent roof constructions that meet the above description are known already now. In fact, this kind of construction uses a metal frame formed of an assembly of profile bars defining, at least as regards the portion forming the roof, a three-dimensional framework inside which are subtended one or several cover elements made of a flexible material, usually of the type with a double curvature.

In fact, one should observe that hitherto such a three-dimensional metal framework uses metal profile bars of an elemental size that are connected to each other by means of connecting nodes, so as to define basic modules (such as described e.g. in DE 1170 6040) that are often in the shape of pyramids. Thus, several of these basic modules can be associated to each other, also by means of the above-mentioned nodes, to finally reach the roof size adapted to the construction. One should note that these often pyramidally shaped basic modules are, in addition, connected to each other by their top.

More in detail, a basic module includes two parallel longitudinal beams, which are furthermore connected to each other by means of crossbeams. With respect to these longitudinal beams extend diagonal beams that define either a pyramidal shape, these diagonal beams joining each other at the level of one and the same node, or two or more girders connected by their top.

One obviously understands that several of these modules can be juxtaposed so as to create a row, which has been defined as a frame module in the following description, it being understood that here too several of these frame modules can be associated to each other to reach the size wanted for the structure.

The problem that nowadays arises with this kind of construction tent roof including, as a roof, a three-dimensional metal framework resides in that their mounting time is particularly long, the more that lacing techniques are usually used for tensioning, at the level of such a framework, the cover elements made of a flexible material and with a double curvature. As a matter of fact, the tensioning of these cover elements most often occurs at the level of the connecting nodes.

On the basis of this finding, one obviously understands that these particular constructions are in no way adapted for a temporary use, since in particularly the mounting and dismantling operations prove particular expensive.

Therefore, though they have a particular attractive aesthetic look, these constructions with a three-dimensional framework with subtended canvases with a double curvature find their usefulness only in the construction of buildings for permanent use, whereas for accommodating a temporary activity, there is no other solution than using more classical constructions.

These use, as the case may be, a substantially planar framework that, for forming the roof, receives one or several covers with a double curvature, in the shape of a Chinese hat, the tensioning of which often occurs from the inside. In this respect, it should be noticed that it is also known to tension these canvases with a double curvature from the outside of the building, by means of shrouds fixed to masts provided for this purpose.

As a matter of fact, one will more usually use tent roof constructions such as cornices or the like the structure of which is comprised of a series of gantries equidistantly connected to each other and formed of an assembly of profile bars with a groove for receiving, between two successive gantries, a cover element made of a flexible material the longitudinal edges of which are pre-provided with a retaining strip. This latter is thus capable of sliding inside the grooves of the above-mentioned profile bars.

One observes that both above-mentioned solutions used for the construction of buildings for temporary use give rise to the problem of their modularity. Thus, though this last-mentioned type of construction is more widely spread because it leads to a reduced mounting time, it is difficult to strictly adapt its shape or also its dimensions to the use it is intended for or even to the location reserved to it. The companies that offer this kind of construction for hire have indeed only a very small number of gantries of different sizes. In addition, when such a hiring company wants to be able to meet a large request from its customers, it must have in stock not only the elements, i.e. structures and covers, corresponding to the most used constructions, but also those for creating constructions of more particular sizes that are exceptionally requested by its customers. Hence, this gives rise to the problem of rotation of stock and thus of the profitability of these elements for constructions of special sizes.

BRIEF SUMMARY OF THE INVENTION

Finally, the aim of this invention is to create a tent roof construction including, in its portion forming the roof, a framework of the three-dimensional type not only the assembling of which is easy because it is without the often very expensive connecting nodes, but that is, in addition, capable of receiving, very easily and with a short mounting time, the cover elements with a double curvature aimed at being subtended at the level of this framework.

At the same time, this invention is aimed at providing a solution for the problem of modularity of the constructions for temporary use.

For this purpose, the invention relates to a construction with a flexible cover at least the portion forming the roof of which is defined by a three-dimensional metal or composite framework comprised of a frame module or a juxtaposition of several of these latter, each of which includes at least two parallel longitudinal beams connected by means of cross beams and from which extend diagonal beams defining, as the case may be, two or more girders made integral by their top or even one or a series of pyramidally-shaped modules, within the inner space delimited by such a frame module being understood to be at least one flexible cover of the type with a double curvature, within both parallel longitudinal beams of a frame module are each defined by a profile bar including at least a through groove for receiving a retaining strip provided for at least two longitudinal edges of the flexible cover or covers with a double curvature aimed at being subtended at the level of the frame module, wherein such a profile bar is provided with means for receiving the ends of the diagonal beams and/or the cross beams, with a view to their fixing.

According to a feature of this invention, a frame module includes a third top longitudinal beam, parallel to the preceding one, which connects the tops, as the case may be, of the girders or the pyramidally-shaped modules defined by the diagonal beams.

Advantageously, the means for receiving, with a view to their fixing, the ends of the diagonal beams and/or the cross-beams at the level of a profile bar defining a longitudinal beam are in the shape of lugs inserted on said profile bar or even in the shape of an attached or co-extruded continuous or discontinuous wing lug.

Furthermore, such a profile bar is preferably made of an aluminium alloy, it being understood that it could also be made of a composite material.

The advantages resulting from this invention consist in that it is possible, through the profile bars aimed at forming the longitudinal beams corresponding to a frame module, to omit the connecting nodes that are usually used for creating three-dimensional metal frameworks. In addition, these longitudinal beams in the shape of grooved profile bars are capable of receiving, through sliding, the retaining strips of a flexible cover the putting in place of which is therefore considerably facilitated.

Finally, through this invention, there is achieved a construction that, while being provided with such a three-dimensional metal or composite framework, proves to have a particularly short mounting and dismantling time, which is a considerable advantage when it is intended for temporary use.

Finally, this kind of construction according to the invention provides the hiring companies with the possibility of optimizing their stock of material. Through a mere juxtaposition of several frame module, it is indeed possible to finally obtain all the desired building sizes, both in length and in width. As a result, this ensures them a better rotation of their stock of material.

Further aims and advantages of this invention will become clear in the course of the following description related to one embodiment that is given only as an indicative and non-limiting example.

BRIEF DESCRIPTION OF THE DRAWINGS

This description will be more easily understood with reference to the attached drawings therefor.

DETAILED DESCRIPTION OF THE INVENTION

Figure 1:
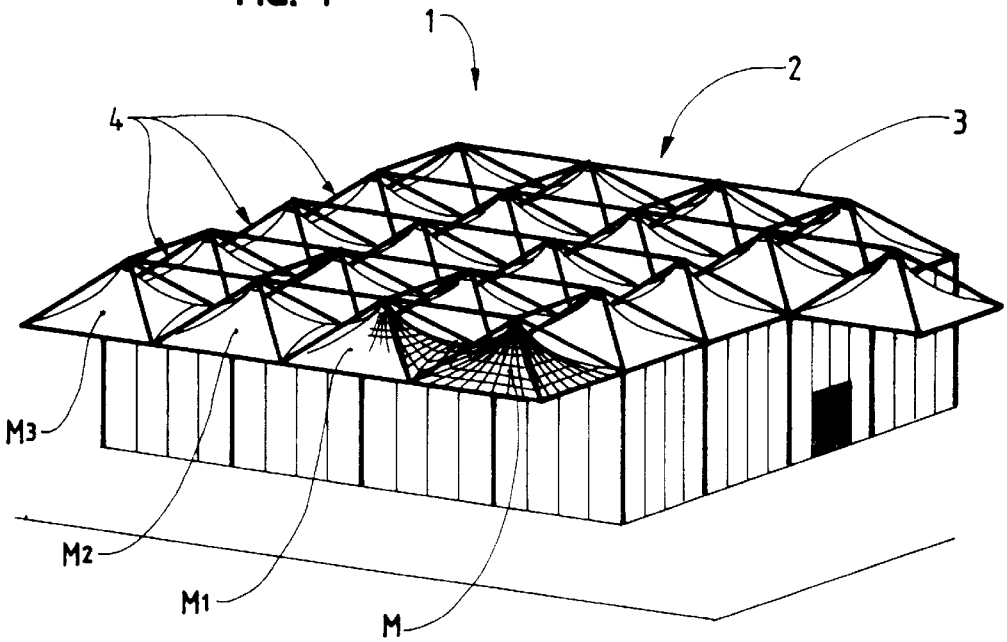
FIG. 1 corresponds to a schematic perspective view of a tent roof construction according to the invention.

As shown in FIG. 1, this invention relates to a tent roof construction 1 at least the portion forming a roof 2 of which is defined by a metal or composite framework of a three-dimensional kind. As a matter of fact, this latter is formed of a frame module 4 or even, as shown in this FIG. 1, of a juxtaposition of several of these latter.

Figure 2:
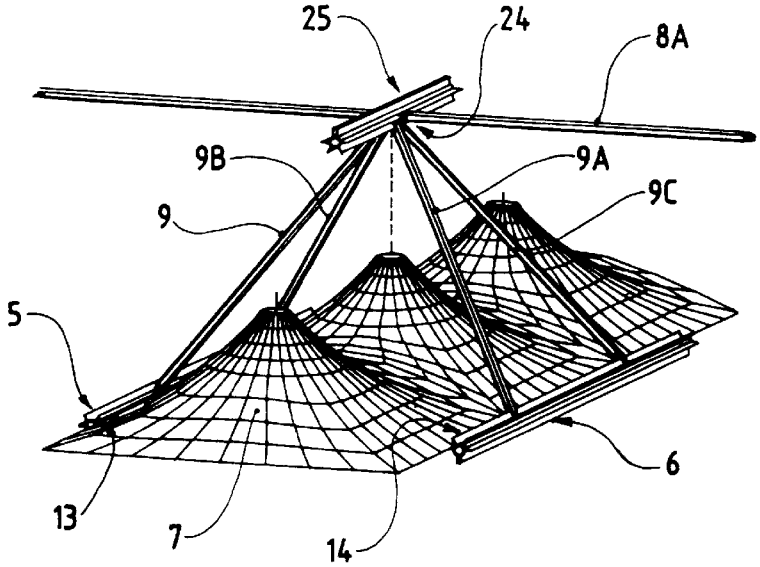
FIG. 2 corresponds to an embodiment of a frame module.
Figure 3:
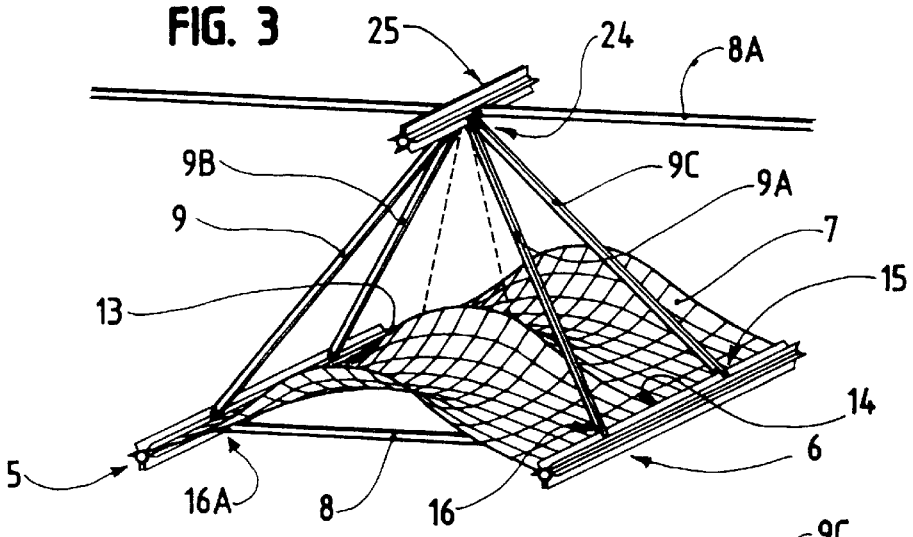
FIG. 3 is a view similar to FIG. 2, showing another embodiment regarding the cover or covers with a double curvature subtended to a frame module.
Figure 4:
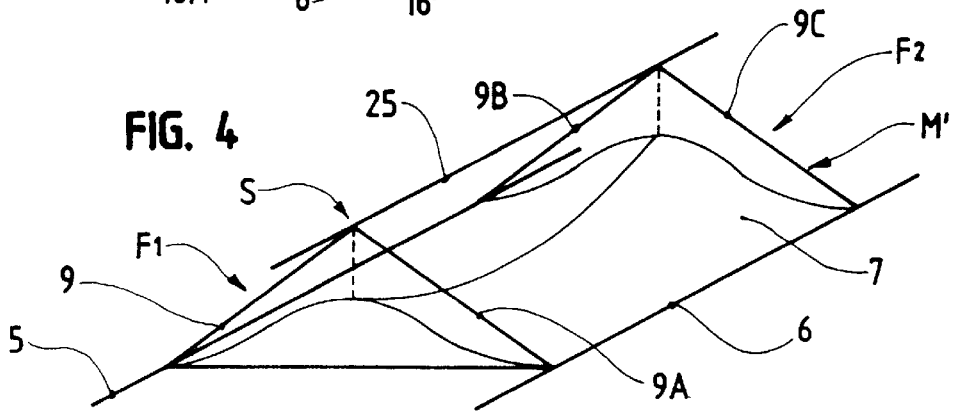
FIG. 4 shows another embodiment of a frame module that includes two girders connected by their top.

As can be seen in particular in FIGS. 2 through 4, such a frame module 4 includes at least two parallel longitudinal beams 5, 6 between which one or several covers with a double curvature 7 are finally aimed at extending, these longitudinal beams 5, 6 being furthermore connected to each other by means of cross beams 8. In addition, from these longitudinal beams 5, 6 are extending diagonal beams 9, 9$^a$, 9B, 9C that, in a configuration shown in FIG. 4, define at least two girders F1, F2 made integral by their top 8, so as to form a module M'. As a matter of fact, such diagonal beams 9, 9A, 9B, 9C more usually define, as shown in FIGS. 1 through 3 of the attached drawings, one or a series of pyramidally-shaped modules M, M1, M2, M3.

Figure 5:
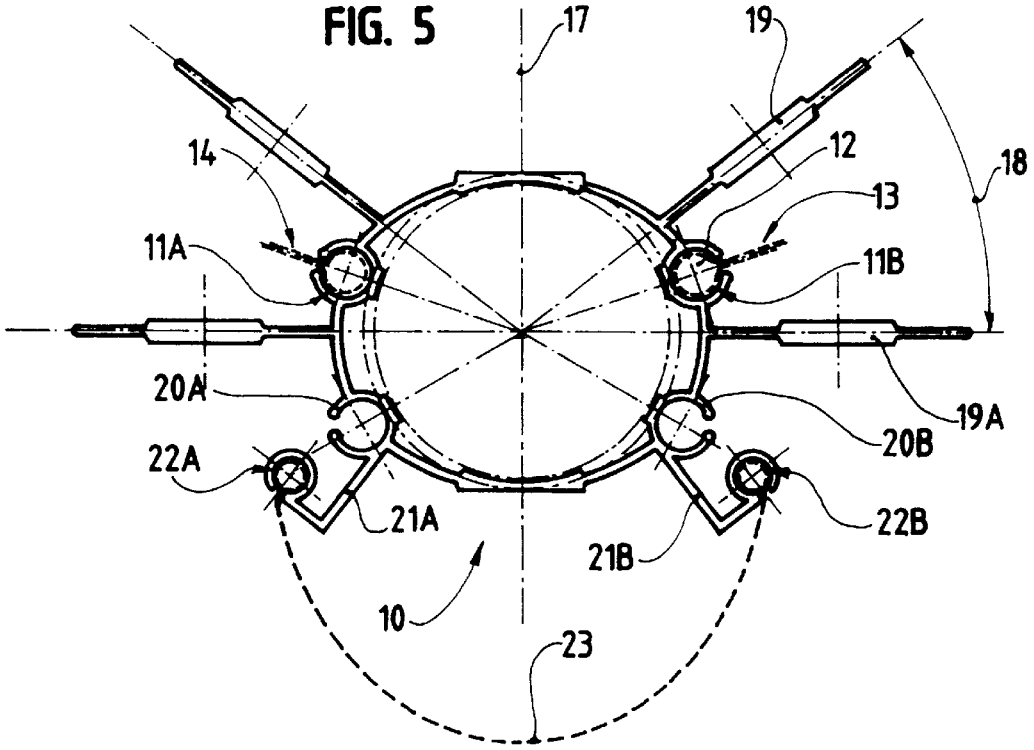
FIG. 5 is a schematic and cross-sectional view of an embodiment of a profile bar aimed at defining a longitudinal beam.
Figure 6:
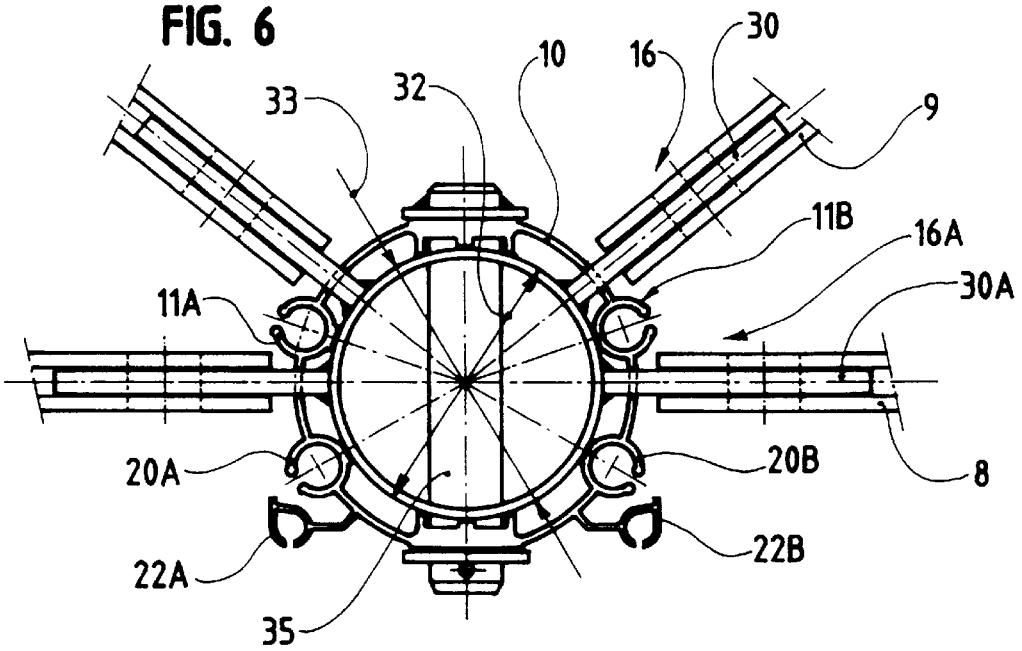
FIG. 6 is a view similar to FIG. 4, which shows another embodiment of such a profile bar as well as of the means for receiving, for their fixing, the ends of the diagonal beams and/or the cross beams.

According to a feature of this invention, both longitudinal beams 5, 6 are each defined by a profile bar 10 for which FIGS. 5 and 6 show, in a cross-sectional view, various embodiments. Thus, such a profile bar 10 includes at least one through groove 11A, 11B for receiving a retaining strip 12 (shown by a broken line) with which are provided both longitudinal edges 13, 14 of a flexible cover with a double curvature 7 aimed at being subtended on this frame module 4.

In addition, such a profile bar 10 forming a longitudinal beam 5, 6 is advantageously provided with means 15 for receiving the ends 16, 16A of the diagonal beams 9, 9A, 9B, 9C and/or of the cross-beams 8, with a view to their fixing.

It should be observed that according to a preferred embodiment, two juxtaposed frame modules 4 share one and the same longitudinal beam for fixing one of the longitudinal edges 13, 14 of their respective cover with a double curvature 7. Under such circumstances, it is convenient that such a longitudinal beam is in addition manufactured so as to be able to receive the diagonal beams corresponding to each of these juxtaposed frame modules 4 as well as, should the case arise, the cross beams 8 connecting the longitudinal beams 5, 6 of each of these latter.

To this end, such a profile bar 10 is advantageously made symmetrically with respect to a vertical plane of symmetry 17 and accordingly includes two through grooves 11A, 11B for receiving the retaining strip 12 with which is provided the longitudinal edge 13, 14, respectively, of the covers with a double curvature 7 corresponding, as a matter of fact, to two juxtaposed frame modules 4.

Figure 7:
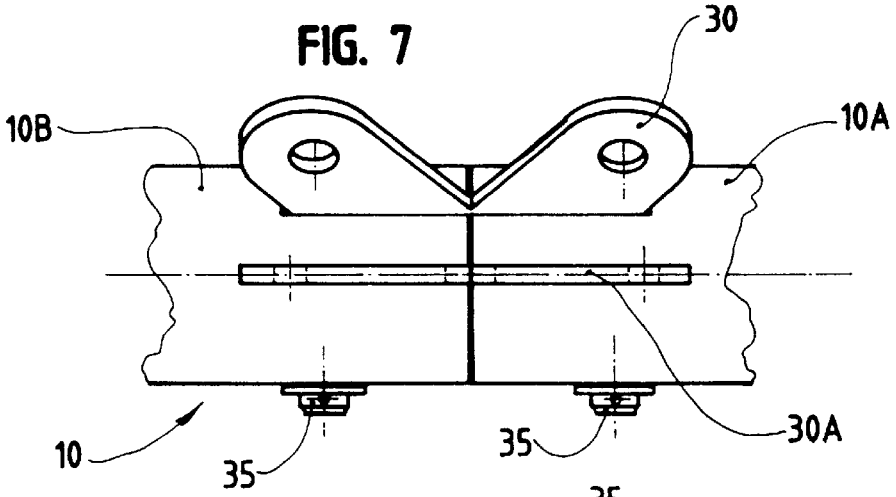
FIG. 7 is another view of these means for receiving diagonal beams and/or cross-beams as shown in FIG. 5.

As regards the means 15 for receiving the ends 16 of the diagonal beams 9, 9A, 9B, 9C or the one 16A corresponding to a cross beam 8, they can be, as shown in FIGS. 6 and 7, in the shape of lugs 30, 30A equidistantly inserted against the profile bar 10. Such lugs 30, 30A obviously extend from this profile bar 10 according to an angle of inclination 18 adapted to the orientation that has to be imparted to the diagonal beams 9, 9A, 9B, 9C or to a cross-beam 8.

One should observe that such lugs 30, 30A may be directly applied, by welding, gluing or screwing, against a profile bar 10. A welding has however a tendency to change the mechanical features of the profile bar, when this latter is of a metallic type. Furthermore, a mechanical connection, such as by screwing, requires a wall thickness at the level of this profile bar that is sufficient to ensure a good connection.

That is why there is a solution consisting which provides a profile bar 10 with lugs 30, 30A through joining parts 31 with an outer cross-section 32 adapted to the inner cross-section 33 of the profile bar that is furthermore defined to be of a tubular type. On such a joining part 31, preferably of a metallic type, made of steel, the lugs 30, 30A are finally inserted, by welding and alongside generating lines, whereas a profile bar 10 is defined by one or several profile bar lengths 10A, 10B onto the ends 34A, 34B of which are inserted joining parts 31 provided with lugs 30, 30A. The actual connection between a joining part 31 and a profile bar length 10A, 10B is achieved by means of a pin 35. In addition, these ends 34A, 34B of the profile bar lengths 10A, 10B are advantageously axially notched for the passing through of the lugs 30, 30A, and to thus allow to ensure a perfect continuity at the level of the joining of two profile bar lengths 10A, 10B.

Finally, one should observe that these latter include a length corresponding to the distance between connections of diagonal and/or cross beams to a longitudinal beam 5, 6, In fact, this length is substantially equal to that of a module M, M1, M2, M3 or M'.

As shown in particular in FIG. 5, such means 15 for receiving the ends 16 of the diagonal beams 9, 9A, 9B, 9C or the one 16A corresponding to a cross-beam 8 may simply be in the shape of one or several wing lugs 19, 19A, and/or of wing lugs radially extending at the periphery of the profile bar 10.

Like for the grooves 11A, 11B, such means for receiving the ends 16, 16A, as the case may be, of diagonal beams 9, 9A, 9B, 9C or cross beams 8 adopt a symmetrical configuration with respect to the vertical pane of symmetry 17 around the profile bar 10.

One should also observe that it may be convenient, for reasons of thermal insulation, to double a cover with a double curvature 7 so as to define, between this latter and the inner portion of the construction 1, an insulating air cushion. To this end, a profile bar 10 may receive a second pair of grooves 20A, 20B arranged at a substantially tially lower level than the grooves 11A, 11B for receiving the retaining strip corresponding to a lining canvas of two juxtaposed frame modules 4.

As can be seen in FIGS. 2 through 4 showing two embodiments of a cover with a double curvature 7 subtended at the level of a frame module 4, the longitudinal beams 5, 6 form the lower portion of the roof that is defined, as a matter of fact, by these covers with a double curvature 7. Under such circumstances, they will have to collect running water the evacuation of which has to be ensured.

Therefore, according to a first embodiment, a profile bar 10 or even a profile bar length 10A, 10B defining this longitudinal beam 5, 6 is foreseen to be of a tubular type, its inner portion forming a gutter capable of collecting and evacuating running water.

Such an embodiment gives however rise to the problem of tightness between two profile bars 10 or profile bar lengths 10A, 10B successively coupled to each other to define a frame module of an increased length adapted to the size of the tent roof construction 1 to be made. Though such tightness is technically feasible, it often leads to the use of seals that will quickly deteriorate during the successive mounting and dismantling of the construction. In this respect, one should in particular take into consideration that because of the size of this kind of construction 1 it is difficult, even impossible, to impart to the longitudinal beams 5, 6 any slanting with a view to facilitate the evacuation of running water.

There has therefore been devised a second embodiment allowing these longitudinal beams 5, 6 to more effectively fill this role of an evacuation gutter for running water. According to this second embodiment, the profile bar 10 or profile bar length 10A, 10B is, directly or through connecting lugs 21A, 21B, provided with a third pair of grooves 22A, 22B for receiving retaining strips of a water-proof canvas 23 capable of extending in the shape of a gutter under such a profile bar 10, under a longitudinal beam 5, 6.

One should observe that the connecting lugs 21A, 21B bearing at their end the grooves 22A, 22B are so configured that the gutter-shaped canvas 23 perfectly extends under these longitudinal beams 5, 6, in a way capable of collecting all running water coming from the covers 7.

Figure 8:
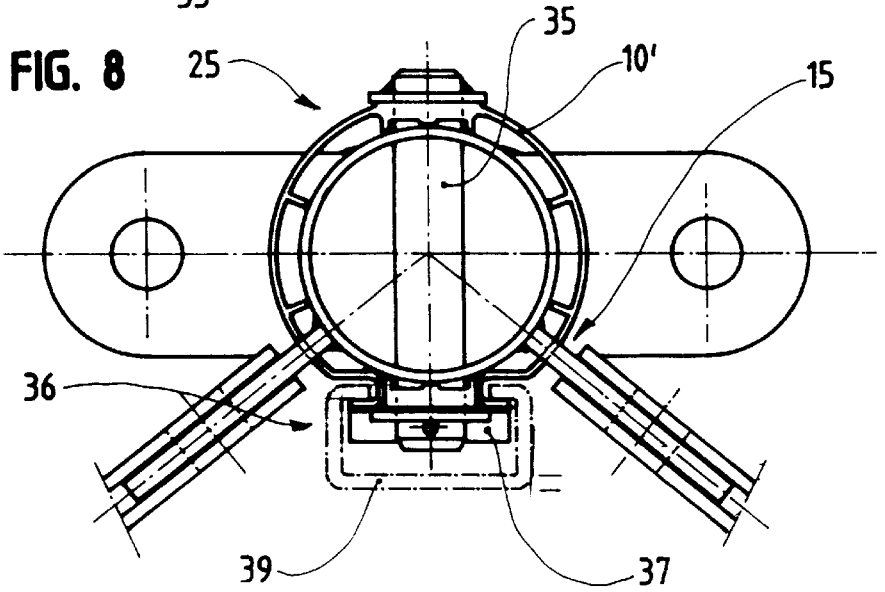
FIG. 8 corresponds to a cross-sectional view of a profile bar capable of defining the third longitudinal beam of a frame module and connecting the tops either of several girders or of pyramidally-shaped modules.

In order to avoid the use of connecting nodes at the level of the top 8 of the girders F1, F2 defined by diagonal beams or, in particular, at the level of the tops 24 corresponding to a pyramidally-shaped module M, M1, M2, M3, a frame module 4 preferably includes at least a third top longitudinal beam 25, also defined by a profile bar 10' including means 15 for receiving, with a view to their fixing, diagonal beams 9, 9A, 9B, 9C (see FIG. 8). This longitudinal beam 25 thus connects to each other either the tops 9 of the girders F1, F2 or the tops 24 of several modules M, M1, M2, M3 of one and the same frame module 4 or corresponding to several juxtaposed frame module 4. Here too, one should note that such a longitudinal beam 25 can be provided with means 15 for receiving cross beams 8A capable of connecting these longitudinal beams 25 two by two.

Though such a longitudinal beam 25 may be without grooves, nothing impedes it from being provided with one or several of them, this in a way similar to a profile bar 10 or a or profile bar length 10A, 10B defining the longitudinal beams 5, 6. Such grooves can receive the retaining strips of a canvas, in particular a netting that is in some way extended above the covers with a double curvature 7, with a view to either protecting them from dirt, leaves, or creating a sun screen.

As can be seen in FIG. 8, the profile bar 10' for defining such a longitudinal beam 25 is, in its lower portion 36, configured in the shape of a rail 37 for receiving one or several (schematically shown) slides 39 to which are attached one or several cables 38 for tensioning the cover or covers with a double curvature 7. Thus, by inserting the retaining strips 12 of a cover with a double curvature 7 into the grooves 11A, 11B of the longitudinal beams 5, 6 of a frame module 4, the slides 39 to which are connected the tensioning cable or cables are simultaneously engaged onto the longitudinal beam 25.

From the preceding description, one obviously understands that the mounting and dismantling of these latter is considerably facilitated, the more that the putting into place of the covers with a double curvature 7 is achieved very easily, whereas their tensioning occurs through a traction exerted substantially in only one direction. Of course, the various particularly tiresome lacing operations are in addition avoided.

Finally, such a tent roof construction 1 according to the invention proves of high modularity through the use of standard parts that, furthermore, allow to omit the connecting nodes that often correspond to particularly expensive parts. Such connecting nodes indeed often require, for their manufacturing, many welding, deep-drawing, machining and similar operations, which operations are particularly rationalized in this case.

One should in addition notice that this invention has been able to artfully solve the problem of tightness of this kind of construction with a three-dimensional framework and a flexible cover, which also corresponds to a not negligible advantage.

What is claimed is:

1. A tent roof construction comprising:

a three dimensional metal framework having at least one frame module, each frame module comprised of a plurality of longitudinal beams connected by cross beams and diagonal beams, wherein said plurality of longitudinal beams are positioned in a pyramidal configuration such that said cross beams connect two bottom longitudinal beams and such that respective diagonal beams connect said two bottom longitudinal beams to a top longitudinal beam so as to define planes of a pyramid, each of said longitudinal beams being comprised of profile bars having a plurality of through grooves for receiving retaining strips and means for receiving ends of said diagonal beams and said cross beams; and a first flexible cover having a double curved conical shape and retaining strips so as to attach to said through grooves of a profile bar of said respective longitudinal beams.

2. The tent roof construction of claim 1, said profile bars being vertically symmetrical, said through grooves of respective said profile bars being positioned on both sides of said profile bars so as to extend along longitudinal edges of said longitudinal beams and so as to receive retaining strips of said first flexible cover along said longitudinal edges.

3. The tent roof construction of claim 2, said profile bars of said bottom longitudinal beams having a second set of through grooves positioned below said through grooves, said second set of through grooves corresponding to respective retaining strips of a second flexible cover so as to form an air pocket for insulation between said first flexible cover and said second flexible cover.

4. The tent roof construction of claim 1, said means for receiving ends of diagonal beams and cross beams comprising lugs, said lugs being positioned equidistant around a circumference of said longitudinal beams.

5. The tent roof construction of claim 4, said lugs being extendable from a surface of said profile bar according to an angle corresponding to a cross beam and an angle corresponding to a diagonal beam.

6. The tent roof construction of claim 4, said profile bar being tubular-shaped and comprised of an inner cross section and an outer cross section such that said lugs are inserted through said outer cross section so that ends of said lugs contact said inner cross section, said ends of said lugs being attached to said inner cross section.

7. The tent roof construction of claim 6, wherein an end of said profile bar is axially notched such that respective ends of profile bars of individual frame modules align and such that said lugs can pass through respective notches of adjacent profile bars.

8. The tent roof construction of claim 1, said means for receiving ends of said cross beams and said diagonal beams comprising wing lugs, said wing lugs extending radially around a periphery of said profile bars.

9. The tent roof construction of claim 1, said means for receiving ends of said cross beams and said diagonal beams being vertically symmetrically dispersed around a circumference of said profile bars.

10. The tent roof construction of claim 1, said profile bars of said bottom longitudinal beams being tubular-shaped and having an inner portion capable of forming a gutter for collecting and evacuating running water coming from said first flexible cover.

11. The tent roof construction of claim 1, said profile bars of said bottom longitudinal beams being tubular-shaped and having respective pairs of grooves for receiving retaining strips of a waterproof canvas to form gutters under said profile bars, said respective pairs of grooves being connected directly to said respective profile bars or indirectly to connecting lugs, wherein said connecting lugs are connected to said respective profile bars.

12. The tent roof construction of claim 1, said top longitudinal beam further comprising a top girder, said top girder connectable to top girders of adjacent top longitudinal beams so as to connect individual frame modules.

13. The tent roof construction of claim 12, said profile bar of said top longitudinal beam further comprising one or more through grooves for receiving a retaining strip of said first flexible cover.

14. The tent roof construction of claim 12, said profile bar of said top longitudinal beam further comprising a rail for receiving one or more slides, said slides being attached to said first flexible cover and attached to one or more cables, said cables for tensioning of said first flexible cover.

* * * * *